US006530489B1

(12) United States Patent
Van Horn et al.

(10) Patent No.: US 6,530,489 B1
(45) Date of Patent: Mar. 11, 2003

(54) ELECTRICALLY-CONDUCTIVE SUPPORT RACK SYSTEM AND METHOD

(75) Inventors: Samuel L. Van Horn, Grove City, OH (US); Daniel L. Van Horn, Orient, OH (US)

(73) Assignee: Springbok, Inc., Bloomingburg, OH (US)

( * ) Notice: Subject to any disclaimer, the term of this patent is extended or adjusted under 35 U.S.C. 154(b) by 0 days.

(21) Appl. No.: 09/931,137

(22) Filed: Aug. 16, 2001

(51) Int. Cl.[7] ..... A47F 5/08
(52) U.S. Cl. ..... 211/113
(58) Field of Search ..... 211/113, 118, 211/13.1; 118/500

(56) References Cited

U.S. PATENT DOCUMENTS 4,217,853 A * 8/1980 Davitz ..... 118/500
4,243,146 A * 1/1981 Davitz ..... 118/500
5,531,334 A * 7/1996 Forby ..... 118/500
5,762,205 A * 6/1998 Davitz ..... 211/117
5,897,709 A * 4/1999 Torefors ..... 118/500
6,189,709 B1 * 2/2001 Cullen ..... 211/118

* cited by examiner

*Primary Examiner*—Alvin Chin-Shue
*Assistant Examiner*—Sarah Purol
(74) *Attorney, Agent, or Firm*—Mueller and Smith, LPA

(57) ABSTRACT

An support rack system, which may be electrically conductive, has one or more generally horizontal crossbars. Each crossbar has a front face and a spaced-apart rear face. Each of the crossbar faces is interconnected at one or more spaced-apart locations to reveal at least one pocket. The crossbar faces are matingly connected adjacent at least one of the pockets. The mating connection of the crossbars has at least one aperture penetrating therethrough. The rack system also has one or more generally parallel, vertically oriented support bars. At least one of the support bars bears a mechanism adapted to attach said crossbars to said support bar with one or more of the crossbar aperture or the crossbar pocket.

29 Claims, 4 Drawing Sheets

10
18
14
16
12
4
4
20
44
32
5
5
22
46
34
24
6
6
48
36
26
7
7
50
38
28
8
8
52
116
40
112
30
54
114
42

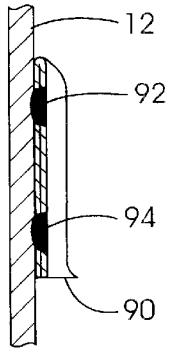
FIG. 6
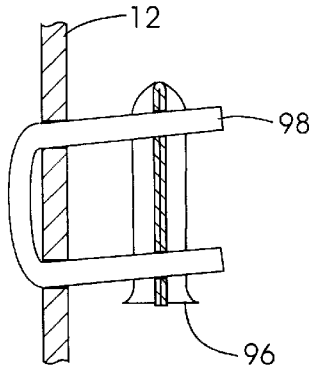
FIG. 7
FIG. 8
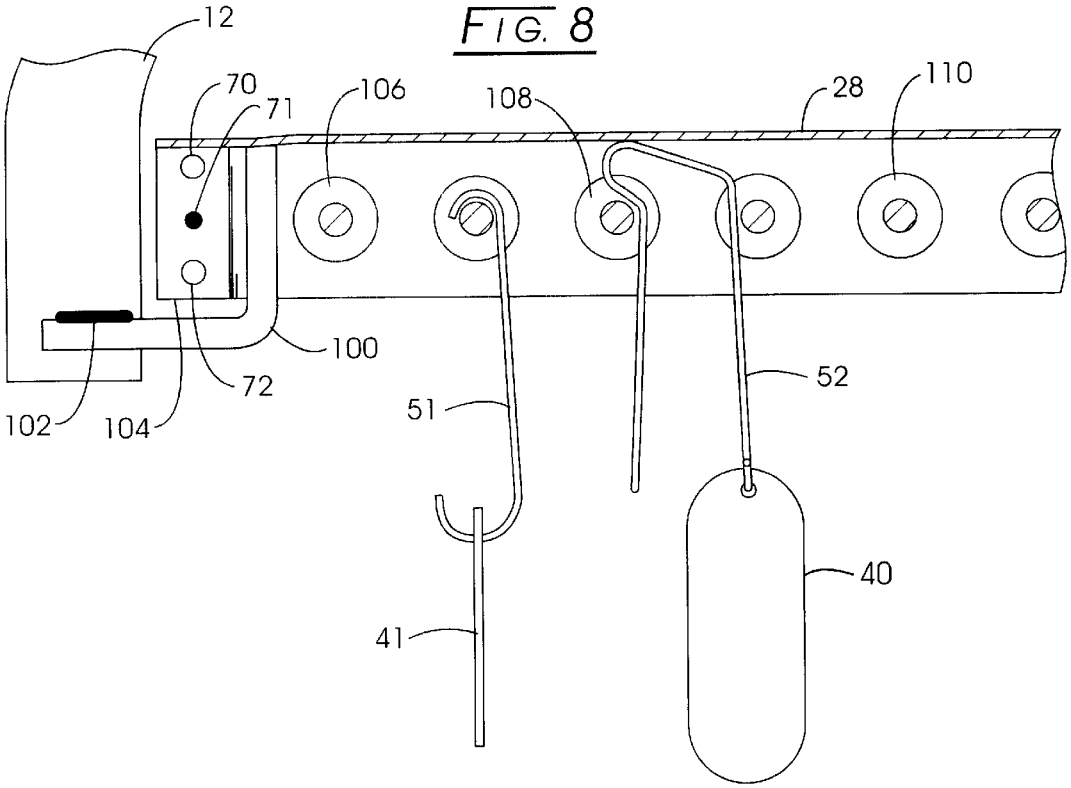

ELECTRICALLY-CONDUCTIVE SUPPORT RACK SYSTEM AND METHOD

CROSS-REFERENCE TO RELATED APPLICATIONS

None.

STATEMENT REGARDING FEDERALLY SPONSORED RESEARCH

Not applicable.

BACKGROUND OF THE INVENTION

The present invention generally relates to racks for supporting workpieces in industrial coating operations and more particularly to a rack design that permits numerous modes of assembly.

Industrial coating systems employ a conveyor from which workpieces are hung on support racks and are conveyed through several stations, usually including stations for performing the steps of cleaning, rinsing, drying, coating, and baking, often including repeats of these steps and often in a different order. In many industrial coating operations, the workpieces travel through an electrostatic coating booth wherein the electrically grounded workpieces are sprayed or coated with electrically charged coating particulates, either liquid or powder. After coating and baking, the coated workpieces are removed from the racks and the racks are reused for another coating cycle. Because of the recycling of the racks, they become coated and encrusted with multiple layers of the coating material. It is important in those instances where electrostatic coating is employed that the support rack be electrically conductive so that workpieces can be maintained in a grounded state. The workpieces are electrically connected to ground through a conductive support rack so that electrically charged particulates are attracted to the workpieces by the electrostatic field.

During each coating cycle, a layer of coating is applied to all exposed electrically conductive surfaces, including the support rack. Unless identical workpieces are coating during each coating cycle, the support racks need to be disassembled for cleaning and reassembly for the next workpiece to be coated. Thus, flexibility in support rack assembly, disassembly, and reassembly is a desired feature.

Heretofore a variety of support rack assemblies have been proposed in the art. U.S. Pat. No. 6,189,709 proposes an electrically conductive rack, which has a crossbar attached to the vertical beams using the open Z-folded end, including a threaded rod and nut assembly (FIG. 4), an S-hook (FIG. 5), vertical wires inserted in an aperture (FIG. 6); and a flat tongue (FIG. 7). U.S. Pat. No. 5,908,120 proposes to attach a vertical rod to the crossbar via an aperture that penetrates vertically through the crossbar. U.S. Pat. No. 5,897,709 proposes to attach an upper horizontal crimped area of the crossbar with a hole to vertical J-hooks that serve as the vertical rod. U.S. Pat. No. 5,531,334 proposes to attach the flat end of the crossbar to the vertical rod with a threaded fastener or rivet (FIG. 7). U.S. Pat. No. 5,524,774 proposes to use holes in the vertical rod to engage elongate hooks for supporting the crossbar. U.S. Pat. No. 5,147,050 proposes to use holes in the vertical rod and spaced-apart fingers of a bracket to support the crossbar. U.S. Pat. No. 5,020,677 proposes to rest the crossbar on supporting fingers extending from the vertical bars wherein spring clips or the like retain the crossbar on the fingers. U.S. Pat. No. 4,899,966 shows an integral crossbar and vertical bar assembly (FIG. 5). U.S. Pat. No. 4,628,859 shows a coat hanger for hanging parts from. U.S. Pat. No. 4,097,359 shows a rectangular bar assembly where the upper and lower crossbars and attached to the left and right vertical bars by "welding, bolting, etc." U.S. Pat. No. 4,097,359 proposes a rectangular bar assembly where the supporting hooks are inserted into U-shaped horizontal bars. U.S. Pat. No. 5,762,205 proposes to hang the horizontal crossbars to vertical channel beams with hooks that protrude from the beams and which fit into the U-shaped crossbars. U.S. Pat. No. 4,037,727 proposes a vertical bar that fits through vertically oriented apertures in the crossbars wherein a thumbscrew holds the bar in position.

It is to a rack assembly with unique design for assembly by a diverse number of mechanisms that the present invention is directed.

BRIEF SUMMARY OF THE INVENTION

An support rack system, which may be made electrically conductive, has one or more generally horizontal crossbars. Each crossbar has a front face and a spaced-apart rear face. Each of the crossbar faces is interconnected at one or more spaced-apart locations to reveal at least one pocket. The crossbar faces are matingly connected adjacent at least one of the pockets. The mating connection of the crossbars has at least one aperture penetrating therethrough. The rack system also has one or more generally parallel, vertically oriented support bars. At least one of the support bars bears a mechanism adapted to attach said crossbars to said support bar with one or more of the crossbar aperture or the crossbar pocket.

Another aspect of the present invention is a method for assembling a support rack system. This method commences with providing one or more generally horizontal crossbars. Each crossbar has a front face and a spaced-apart rear face. Each of the faces are interconnected at one or more spaced-apart points to reveal pockets between the points. The faces are conformingly pinched together adjacent to at least one of the pockets. The pinch has at least one aperture penetrating therethrough. One or more generally parallel, vertically oriented support bars also are provided. At least one of the support bars bears a mechanism adapted to attach the crossbars to the support bar using one or more of the crossbar aperture or the crossbar pocket. Finally, one or more crossbars are attached to the one or more support bars with the mechanism attached to one or more of the crossbar aperture or the crossbar pocket.

A further aspect of the present invention is a method for industrial coating of workpieces hung from support racks which racks are affixed to a conveyor. The first step is to provide the support rack system. Then a workpiece is hung from at least one of the crossbars. The rack system is hung from a conveyor. Finally, the workpiece is subjected to industrial coating, e.g., electrostatic powder coating, oil coating, latex coating.

Advantages of the present invention include a rack system design that is easy to assemble. Another advantage is a rack system that can be manufactured to be easily disassembled. A further advantage is a rack system that can be assembled using a variety of mechanisms. Yet another advantage is a rack system that can be configured into a variety of patterns. These and other advantages will be readily apparent to those skilled in this art based upon the disclosure set forth herein.

BRIEF DESCRIPTION OF THE DRAWINGS

For a fuller understanding of the nature and advantages of the present invention, reference should be had to the following detailed description taken in connection with the accompanying drawings, in which:

FIG. 6 is a cross-sectional view taken along line 6—6 of FIG. 1;

FIG. 7 is a cross-sectional view taken along line 7—7 of FIG. 1;

FIG. 8 is a cross-sectional view taken along line 8—8 of FIG. 1.

The drawings will be described in more detail below.

DETAILED DESCRIPTION OF THE INVENTION

On occasion, the user may want the support rack, which may be electrically conductive, (or "support rack") assembled permanently. On occasion, the user may want to be able to disassemble the support rack for cleaning and reassembly. On other occasions, the user may want to be able to disassemble the support rack and reassemble it in a different configuration. The inventive support rack provides the user with all of these features.

Figure 1:
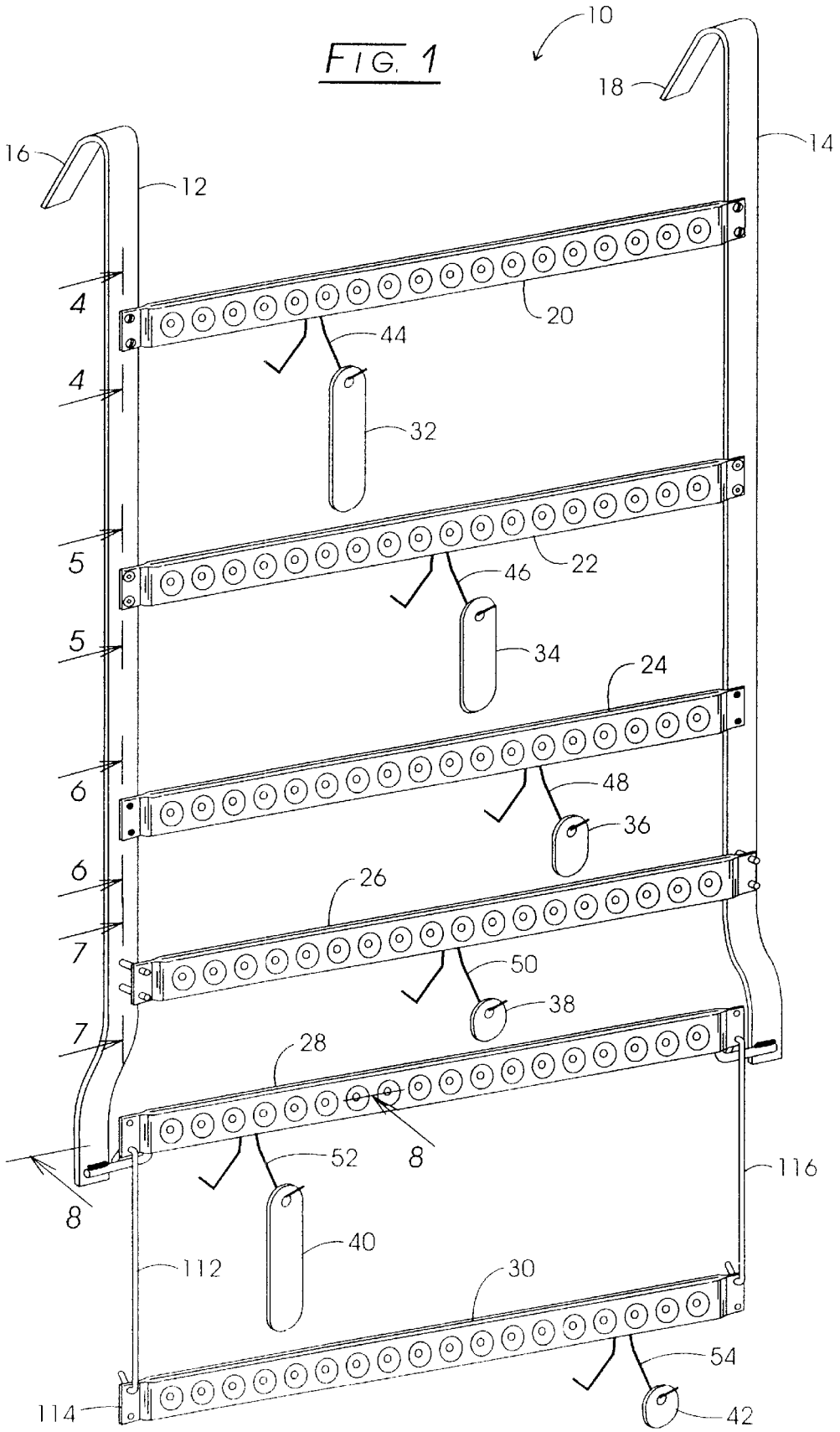
FIG. 1 is a front perspective view of the electrically conductive support rack system showing five different mechanisms for assembly.
Figure 2:
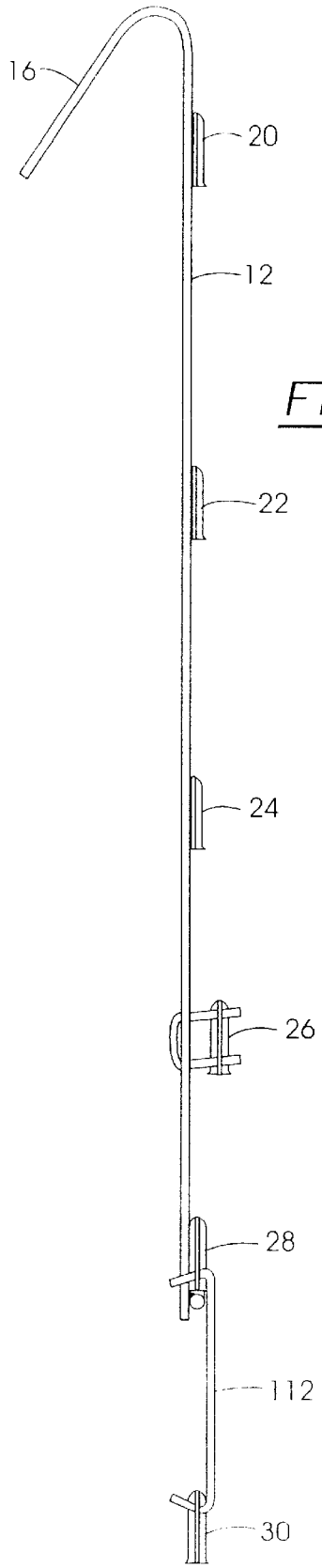
FIG. 2 is a side elevational view of the support rack system of claim 1.

Referring initially to FIG. 1, electrically conductive support rack, 10, is seen to include a pair of spaced-apart, generally vertically oriented, side support bars, 12 and 14, each of which have an upper hook section, 16 and 18, respectively, for attachment, for example, to an overhead conveyor (not shown). Other modes of attachment of support rack 10, of course, are well known in the art and/or can be conceived. Side support bars 12 and 14 are shown to be generally flat (see FIG. 2), but can be of other cross-sectional configuration, as can be appreciated by the skilled artisan.

Figure 3:
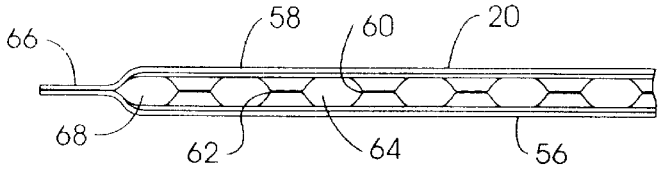
FIG. 3 is a bottom view of one of the horizontal crossbars of the support rack system of claim 1.
Figure 4:
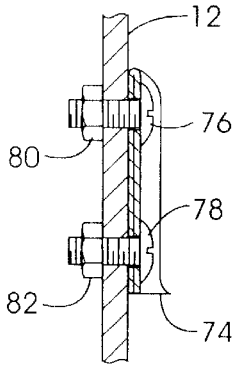
FIG. 4 is a cross-sectional view taken along line 4—4 of FIG. 1.

Side support bars 12 and 14 carry therebetween generally horizontal, crossbars, 20, 22, 24, 26, 28, and 30. Each of these crossbars is seen to carry workpieces, 32, 34, 36, 38, 40, and 42, respectively. A spring clip, known as a gravity hook in the industry, 44, 46, 48, 50, 52, and 54, respectively, carries each workpiece. Each spring clip is inserted between pockets formed in each crossbar, such as is illustrated in FIG. 3. Crossbar 20 is representative of the other crossbars shown in FIG. 1. It will be seen that crossbar 20 is formed from a pair of generally parallel faces, a front face, 56, and a spaced-apart rear face, 58. The faces are interconnected at spaced-apart junctions or dimples, such as junctions, 60 and 62, which are representative of all such junctions. Disposed between junctions 60 and 62 is a pocket, 64. The spring clips, such as spring clip 44 fits into these pockets and is retained thereby. Other means of attaching clips or gravity hooks to the crossbars for holding workpieces are known in the art and can be envisioned by the skilled artisan.

Of importance for present purposes is the end, 66, of crossbar 20. End 66 has been pinched to form an integral segment and an adjacent pocket, 68. End segment 66 also contains at least one hole or aperture, for example a pair of holes, 70 and 72, as shown in FIG. 8 (see also FIGS. 1, 4, 5, 6, and 7). End segment 66 optionally may be welded also, such as a central weld, 71. Crossbar 20, and indeed the other crossbars shown in FIG. 1 as well, are attached to vertical bars 16 and 18 using the apertures in end segment 66 and adjacent pocket 68. Such attachment can be permanent or can be temporary for quick disassembly of support rack 10. Pinched end 66 also prohibits coating medium from entering the crossbars from the sides (or ends); thus, keeping the inside clear of buildup that would be detrimental to good electrical contact.

Six different modes of attachment of the crossbars to the vertical support bars are illustrated in the drawings for illustration purposes, as the skilled artisan may conceive of additional modes of attachment. With respect to crossbar 20, reference is made to FIG. 4 whereat one of the ends, 74, having a pair of vertically-oriented apertures is used to secure crossbar 20 to vertical support bar 12 using threaded bolts, 76 and 78, held by nuts, 80 and 82, respectively. In this mode of attachment, crossbar 20 can be removed merely by unscrewing nuts 80 and 82, and removing threaded bolts 76 and 78. Of course vertical support bar 12 also has a pair of apertures for insertion of threaded bolts 76 and 78 therethrough.

Figure 5:
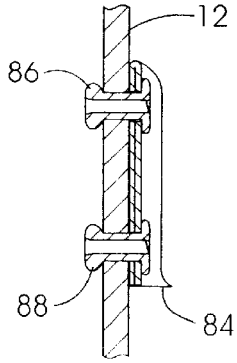
FIG. 5 is a cross-sectional view taken along line 5—5 of FIG. 1.

A second mode of attachment is illustrated in FIG. 5, wherein an end, 84, of crossbar 22 has a pair of vertically-oriented apertures that mate with corresponding apertures in vertical support bar 12. Rivets, 86 and 88, are inserted through these apertures to secure cross bar 22 to vertical support bar 12. This rivet mode of attachment is more permanent than threaded bolts and nuts, though it can be removed with effort.

A third mode of attachment is illustrated in FIG. 6, wherein an end, 90 of crossbar 24 has been spot welded to vertical support bar 12 with a pair of spot welds, 92 and 94. Any suitable welding means can be used. Such welding mode of attachment is even more permanent than the first two modes described above.

A fourth mode of attachment is illustrated in FIG. 7, wherein and end, 96, of crossbar 26 has a pair of apertures (again, like apertures 70 and 72) as does vertical support bar 12. A U-shaped clip, 98, is placed through the apertures in vertical support bar 12 to reveal a pair of ends through which the apertures in end 96 are inserted for carrying crossbar 26. Clip 98 could be permanently attached to vertical support bar 12 or could be removably attached to vertical support bar 12. In this mode of attachment crossbar 26 can be removed readily. If more than one crossbar were hung with such clips, different length clips could space the crossbars different distances from the vertical bars. Again, the flexibility of the inventive rack is illustrated.

A fifth mode of attachment is illustrated in FIG. 8, wherein a L-shaped clip, 100, is welded to vertical support bar 12 by a spot weld, 102. The upper leg of clip 100 is inserted into the pocket formed between an end, 104, and a dimple, 106. whereat the front and back sections of crossbar 28 are joined. Similar pockets are formed between all of the dimples. The end pocket, however, is particularly useful in securing the crossbars to the vertical support bars. This drawing also shows how spring clip 52 is retained between a pair of dimples, 108 and 110, for carrying workpiece 40. A conventional C-clip, 51, also is seen carrying a workpiece, 41. Each of the dimples have a central core of physical contact between the faces of the crossbars, which core can support various conventional or special designed clips for supporting a variety of workpieces.

A sixth mode of attachment relies of the apertures in the ends of the crossbars, such as aperture 72 of end 104 of crossbar 28. In FIG. 1, a gravity hook, 112, having bent ends is inserted through lower aperture 72 of crossbar 28 and an upper aperture in an end, 114, of crossbar 30. A similar gravity hook, 116, arrangement is seen on the other end of crossbars 28 and 30 for crossbar 28 to carry crossbar 30.

Figure 9:
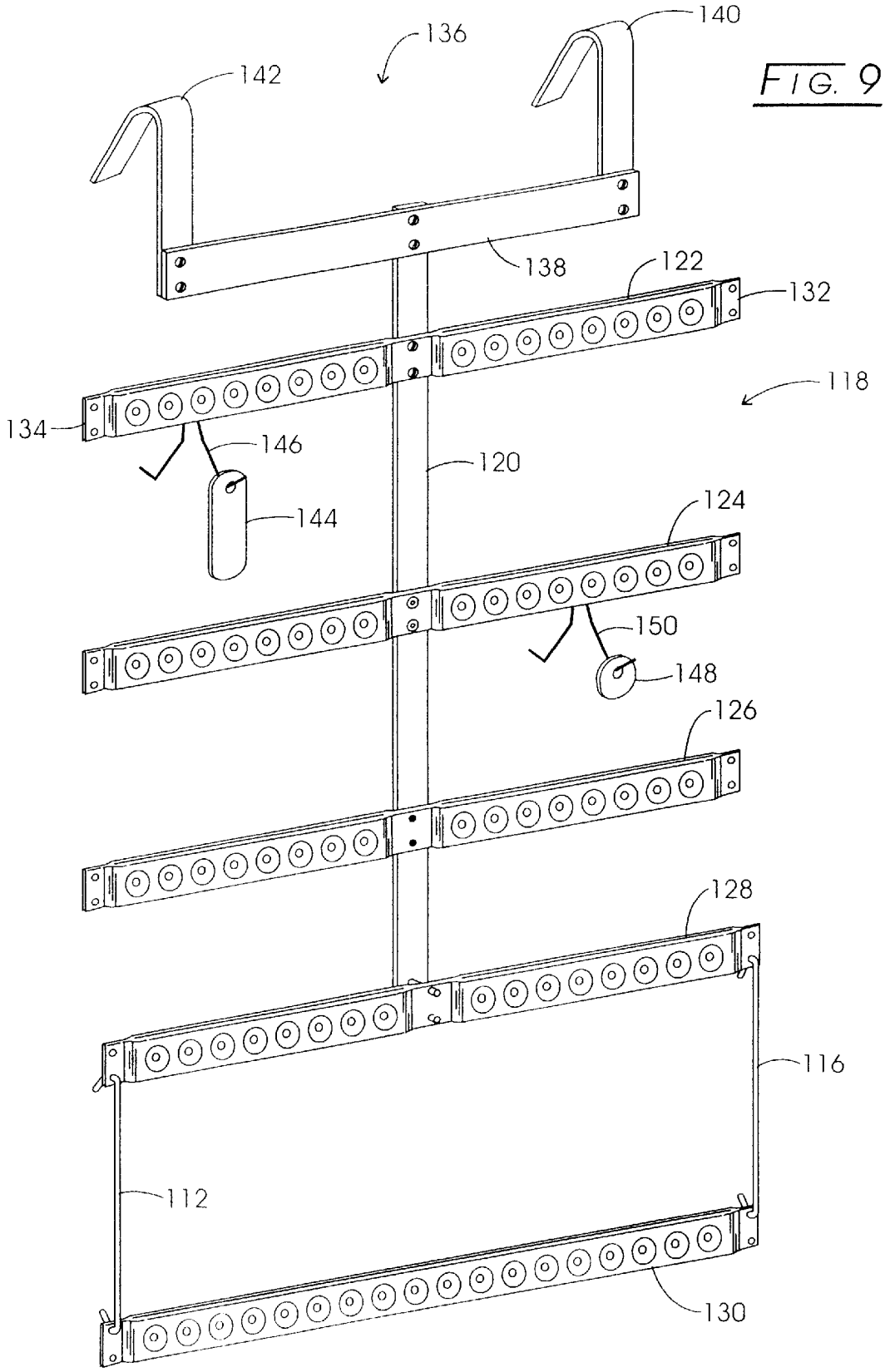
FIG. 9 is a front perspective view of an alternative embodiment of the electrically conductive support rack system.

Finally, while a pair of vertical support bars have been illustrated in the drawings, it will be readily apparent that one or more vertical support bars could be used. In other configurations where the crossbars are not supported at the ends of the crossbars, the crossbars still desirably are pinched or otherwise closed to prevent unwanted penetration of coating material. FIG. 9 illustrates an alternative embodiment of the electrically conductive support rack. In particular, a rack, 118, is seen to be constructed from a single vertical support bar, 120, from which crossbars, 122, 124, 126, 128 and 130, are hung. In this regard, the ends of each crossbar are closed (e.g., closed ends 132 and 134 of crossbar 122) to prevent infiltration of coating, e.g., powder coating, during coating operations. Vertical support bar 120 is supported by a rack assembly, 136, which is composed of a horizontal member, 138, which is supported by J-hook members, 140 and 142. Other configurations for rack assembly 136 can be envisioned by the artisan and can be used to support the novel rack assembly, as those skilled in the art will appreciate.

Crossbar 122 is shown affixed to vertical support bar 120 by screws, as described for crossbar 20 in FIG. 1. Crossbar 124 is shown affixed to vertical support bar 120 by pop rivets, as described for crossbar 22 in FIG. 1. Crossbar 126 is shown affixed to vertical support bar 120 by welds, as described for crossbar 26 in FIG. 1. Crossbar 128 is shown affixed to vertical support bar 120 by U-clips, as described for crossbar 28 in FIG. 1. Finally, crossbar 130 is shown carried by crossbar 128 using clips 112 and 116, as described for crossbar 30 in FIG. 1.

In order for such modes of attachment to be utilized in for support rack 118, a central section of each crossbar is pinched flat and provided with holes or apertures, similar to end 66 in FIG. 3. It will be appreciated that one or more vertical support bars can be used in constructing the novel electrically conductive support rack, again adding to the flexibility of its design. A workpiece, 144, is seen suspended from crossbar 122 via a clip, 146. A workpiece, 148, is seen suspended from crossbar 124 via a clip, 150. These workpieces are not the same size and weight. The novel support rack, again, is flexible in design for handling such different sized and weighted workpieces. Alternatively, added weight can be added to one or more crossbars to balance the support rack, if necessary, desirable, or convenient.

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated. Also, all citations referred herein are expressly incorporated herein by reference.

What is claimed is:

1. A horizontal crossbar for use in a support rack system of one or more generally horizontal crossbars carried by one or more generally vertical support bars, said horizontal crossbar comprising:

a crossbar having a front face, a pair of ends, and a spaced-apart rear face, each of said faces being interconnected at one or more spaced-apart points to reveal pockets between said points, the ends of said faces being conformingly pinched together adjacent to at least one of said pockets to prohibit coating medium from penetrating thereinside, at least one of said pinches having at least one aperture penetrating therethrough for attachment of the crossbar to a vertical support bar.

2. The crossbar of claim 1, wherein said pinch has at least one aperture penetrating therethrough for attachment of the crossbar to a vertical support bar.

3. A support rack system, which comprises:

(a) one or more generally horizontal crossbars, each crossbar having a front face, a pair of ends, and a spaced-apart rear face, each of said faces being interconnected at one or more spaced-apart points to reveal pockets between said points, the ends of said faces being conformingly pinched together adjacent to at least one of said pockets, said pinches having at least one aperture penetrating therethrough; and (b) one or more generally parallel, vertically oriented support bars, at least one of said support bars bearing a mechanism adapted to attach said crossbars to said support bar using one or more of said crossbar aperture or said crossbar pocket.

4. The support rack system of claim 3, wherein said one or more crossbars contain a plurality of said interconnected points.

5. The support rack system of claim 3, wherein said crossbar pinches have a pair of apertures.

6. The support rack system of claim 3, wherein said pinches are spot-welded.

7. The support rack system of claim 3, which is electrically conductive.

8. The support rack system of claim 3, which has a plurality of support bars.

9. The support rack system of claim 3, wherein said support bar has one or apertures that mate with said crossbar one or more apertures.

10. The support rack system of claim 9, wherein said mechanism is one or more of screws, rivets, welds, clips, or hooks.

11. The support rack system of claim 3, wherein said mechanism is one or more of screws, rivets, welds, clips, or hooks.

12. The support rack system of claim 3, wherein said crossbar is removably attached to said support bar.

13. The support rack system of claim 3, wherein a first crossbar having an aperture is suspended from a second crossbar having an aperture via clips that are placed through said apertures, wherein said first crossbar is attached to said support bar.

14. A method for assembling a support rack system, which comprises the steps of:

(a) providing one or more generally horizontal crossbars, each crossbar having a front face, a pair of ends, and a spaced-apart rear face, each of said faces being interconnected at one or more spaced-apart points to reveal pockets between said points, the ends of said faces being conformingly pinched together adjacent to at least one of said pockets, said pinches having at least one aperture penetrating therethrough;

(b) providing one or more generally parallel, vertically oriented support bars, at least one of said support bars bearing a mechanism adapted to attach said crossbars to said support bar using one or more of said crossbar aperture or said crossbar pocket; and (c) attaching said one or more crossbars to said one or more support bars with said mechanism attached to one or more of said crossbar aperture or said crossbar pocket.

15. The method of claim 14, wherein said support bar has one or apertures that mate with said crossbar one or more apertures for attaching said crossbars to said crossbars.

16. The method of claim 15, wherein said mechanism is one or more of screws, rivets, welds, clips, or hooks.

17. The method of claim 14, wherein said mechanism is one or more of screws, rivets, welds, clips, or hooks.

18. The method of claim 14, wherein said crossbar is removably attached to said support bar.

19. The method of claim 14, wherein a first crossbar having an aperture is suspended from a second crossbar having an aperture via clips that are placed through said apertures, wherein said first crossbar is attached to said support bar.

20. Method for industrial coating of workpieces hung from support racks which racks are affixed to a conveyor, which comprises the steps of:

(a) providing a support rack system, which comprises:

(i) one or more generally horizontal crossbars, each crossbar having a front face, a pair of ends, and a spaced-apart rear face, each of said faces being interconnected at one or more spaced-apart points to reveal pockets between said points, the ends of said faces being conformingly pinched together adjacent to at least one of said pockets, said pinches having at least one aperture penetrating therethrough; and (ii) one or more generally parallel, vertically oriented support bars, at least one of said support bars bearing a mechanism adapted to attach said crossbars to said support bar using one or more of said crossbar aperture or said crossbar pocket;

(b) hanging a workpiece from at least one of said crossbars;

(c) hanging said rack system from a conveyor; and (d) subjecting said workpiece to industrial coating.

21. The method of claim 20, wherein said one or more crossbars contain a plurality of said interconnected points.

22. The method of claim 20, wherein said crossbar pinches have a pair of apertures.

23. The method of claim 20, wherein said rack system is electrically conductive.

24. The method of claim 20, wherein said rack system has a plurality of support bars.

25. The method of claim 20, wherein said support bar has one or apertures that mate with said crossbar one or more apertures.

26. The method of claim 23, wherein said mechanism is one or more of screws, rivets, welds, clips, or hooks.

27. The method of claim 20, wherein said mechanism is one or more of screws, rivets, welds, clips, or hooks.

28. The method of claim 20, wherein said crossbar is removably attached to said support bar.

29. The method of claim 20, wherein a first crossbar having an aperture is suspended from a second crossbar having an aperture via clips that are placed through said apertures, wherein said first crossbar is attached to said support bar.

* * * * *